US005419749A

United States Patent [19]

Morgenstein

[11] Patent Number: 5,419,749

[45] Date of Patent: May 30, 1995

[54] LEG AND ARM EXERCISER

[76] Inventor: René Morgenstein, 3680 NW. 16th St., Lauderhill, Fla. 33311

[21] Appl. No.: 165,522

[22] Filed: Dec. 13, 1993

Related U.S. Application Data

[63] Continuation of Ser. No. 941,213, Sep. 4, 1992, abandoned.

[51] Int. Cl.[6] ..... A63B 21/06

[52] U.S. Cl. ..... 482/99; 482/103; 482/133

[58] Field of Search ..... 482/93–103, 482/129–130, 904, 142, 908; 601/5, 23, 33, 34

[56] References Cited

U.S. PATENT DOCUMENTS

| | | | |
|---|---|---|---|
| 511,251 | 12/1893 | Pickles | 482/129 |
| 1,965,511 | 7/1934 | Preston | 482/129 |
| 3,373,993 | 3/1968 | Oja et al. | 482/102 |
| 3,826,490 | 7/1974 | Mossman | 482/904 X |
| 3,834,694 | 9/1974 | Pridgen | 482/133 X |
| 4,084,815 | 4/1978 | Flannery | 482/94 |
| 4,243,219 | 1/1981 | Price | 482/103 |
| 4,286,782 | 9/1981 | Fuhrhop | 482/133 X |
| 4,422,636 | 12/1983 | deAngeli . | |
| 4,544,155 | 10/1985 | Wallenbrock et al. | 482/139 X |
| 4,591,149 | 5/1986 | Godfrey . | |
| 4,700,944 | 10/1987 | Sterba et al. | 482/98 |
| 4,781,374 | 11/1988 | Lederman | 482/103 |
| 4,830,365 | 5/1989 | March . | |
| 4,902,002 | 2/1990 | Huang | 482/908 X |
| 5,002,271 | 3/1991 | Gonzales . | |
| 5,005,831 | 4/1991 | Hara . | |
| 5,006,004 | 11/1991 | Jones . | |
| 5,106,080 | 4/1992 | Jones . | |
| 5,158,518 | 10/1992 | Pizzuto | 482/102 |

FOREIGN PATENT DOCUMENTS

| | | | |
|---|---|---|---|
| 3738752 | 6/1989 | Germany | 482/103 |

*Primary Examiner*—Richard J. Apley
*Assistant Examiner*—John Mulcahy
*Attorney, Agent, or Firm*—Oltman and Flynn

[57] ABSTRACT

Exerciser for exercising arms and legs including an arrangement for raising one leg in stretching fashion in any desired direction. Once a leg is stretched, the leg can be connected to the weights to lift them. The machine can also be used for boxing exercises. According to the invention there is provided a leg and arm exerciser having a vertically slidable weight, a strap for attachment to at least one of an ankle or a hand, a pulley and rope connecting the weight with the strap for raising the weight with the leg or arm, and a frame for supporting the weight and the pulley and rope. There is also provided a knee strap connected to the frame by a rope guided by a slidable pulley for supporting the knee in a raised position. The weight includes a plurality of weight elements, and wherein the plurality of weight elements is adjustable according to a desired heaviness of the weight, and wherein the frame has at least two forward uprights, a vertically adjustable cross member vertically adjustably arranged between the forward uprights, and at least one first pulley of the pulley and rope rotatably attached to the cross member.

11 Claims, 4 Drawing Sheets

LEG AND ARM EXERCISER

This application is a continuation of application Ser. No. 07/941,213, filed Sep. 04, 1992, and now abandoned.

The invention relates to an exercising machine for developing leg and arm muscles, and in particular an exercising machine directed to exercising the leg and arm muscles most needed in martial arts exercises.

BACKGROUND AND PRIOR ART

Exercising devices for developing muscles and maintaining muscle tone are well known in many forms, such as special stationary exercise bicycles with mile counters and adjustable drag on the wheels.

Other exercising devices are known which have adjustable weights coupled by suitable linkages to handles and levers to be operated by an exercising person.

No exercising device, however, is known which is especially directed to exercising those muscles most used in the martial arts, which require for example high kicking movements of the feet, both in forward and backward direction.

Martial arts practice also includes strengthening of the arm muscles groups that are used in the forward thrusting of the hands.

It is accordingly an object of the instant invention to provide an exercising device especially directed to exercising those muscles groups of the arms and legs that are important in martial arts exercises.

SUMMARY OF THE INVENTION

The basic idea of the invention is to provide means for raising one leg in stretching fashion in any desired direction. Once a leg is stretched, the leg can be connected to the weights to lift them. The machine can also be used for boxing exercises.

According to the invention there is provided a leg and arm exerciser comprising a vertically slidable weight, a strap for attachment to at least one of an ankle or a hand, pulley and rope means connecting the weight with the strap for raising the weight with the leg or arm, and a frame for supporting the weight and the pulley and rope means.

According to a further feature there is provided a leg and an arm exerciser wherein the weight includes a plurality of weight elements, and wherein the plurality of weight elements is adjustable according to a desired heaviness of the weight, and wherein the frame has at least two forward uprights, a vertically adjustable cross member vertically adjustably disposed between the forward uprights, and at least one first pulley of the pulley and rope means rotatably attached to the cross member.

The leg and arm exerciser can further have a forward projecting support element connected between a top part of the frame and floor level for preventing the frame from tipping forward during exercising.

The leg and arm exerciser additionally may include second pulley and rope means, a knee strap connected to the second rope and pulley means for supporting a knee of the person in raised position.

The leg and arm exerciser may further have adjustable stops on the second pulley ,and rope means for maintaining the knee at a fixed height according to a selected one of the adjustable stops, wherein the adjustable stops include a plurality of beads on the rope of the second pulley and rope means and an inverted keyhole slot for retaining a selected one of the beads in the inverted keyhole slot.

According to a further feature the leg and arm exerciser has securing means for vertically securing the cross member at a selected height on the uprights, wherein the securing means have a vertical channel in each of the uprights, and a plurality of cutouts in the channel for supporting the cross member at its ends in respective cutouts, and wherein the cross member can be a round bar, and including a pawl with a hole for receiving a respective end of the round bar, with the pawl having a pawl tip for securing the round bar in the cutout, and the pawl tip is adapted to rest against an inside wall of the upright.

The leg and arm exerciser according to the invention may include a horizontal base for supporting the exerciser on a floor surface.

The frame of the exerciser is advantageously shaped as an upstanding parallelepiped having four uprights, the uprights having upper and lower ends, the upper and lower ends respectively connected by an upper and lower end frame shaped like a parallelogram.

The frame of the leg and arm exerciser may have a pair of hand rests, with each hand rest attached to a respective upright projecting away from the frame, and may further include in the first pulley and rope means an upper pulley attached to an upper part of the frame, and a rope reaching from the ankle or hand strap to the first pulley, from the first pulley to the upper pulley, and from the upper pulley to the weight.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
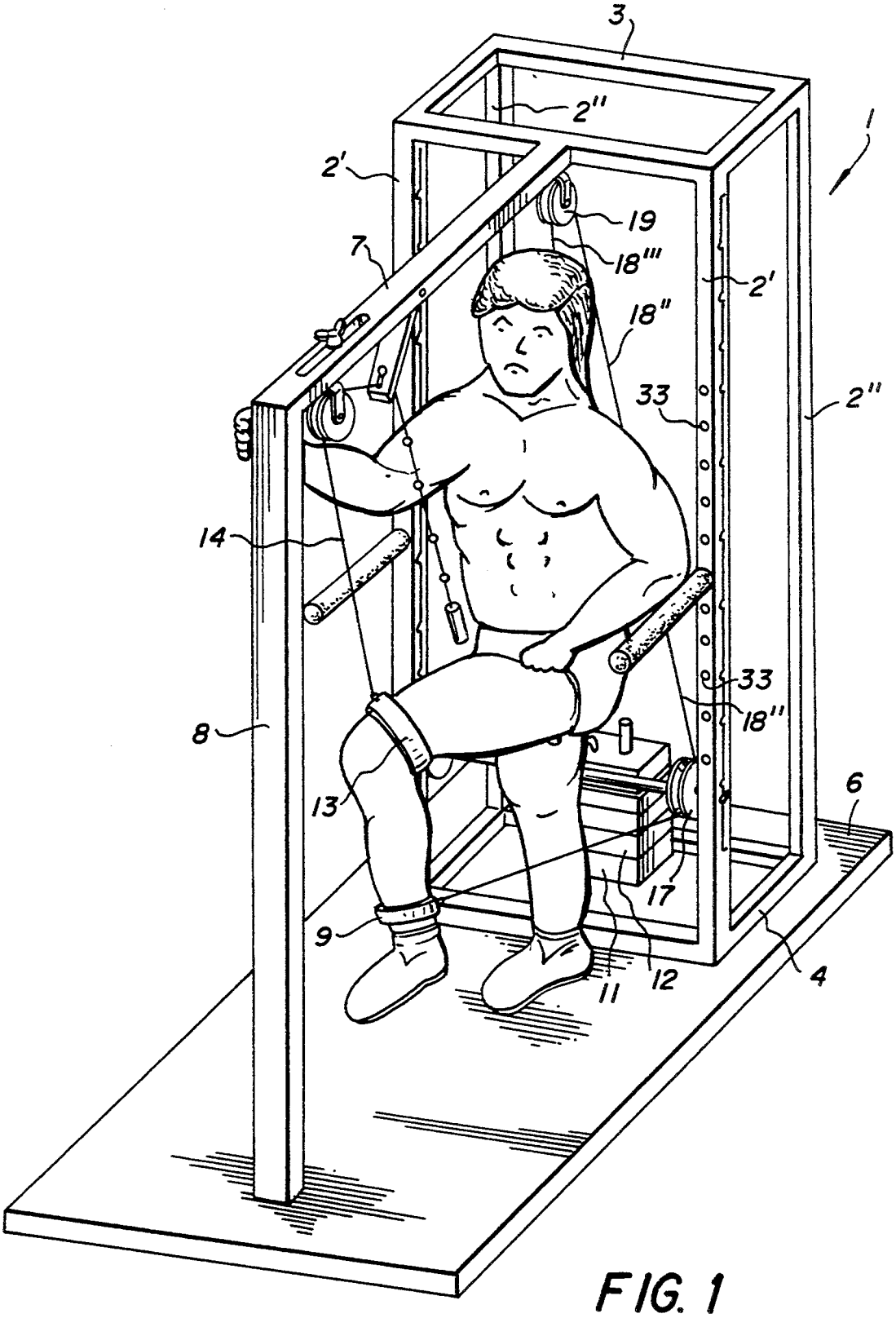
FIG. 1 is an elevational perspective view of the invention showing a person exercising leg muscles.

FIG. 1 shows a frame 1 of structural members forming an elongate upstanding parallelepiped, including in particular two forward uprights 2' and two rear uprights 2''. The uprights have upper and lower ends joined in respective upper and lower rectangular end frames 3 and 4.

The entire frame is advantageously mounted on a base 6, and has a forward projecting support element 7 extending from the upper rectangular end frame 3 forward to join a vertical support column 8, rising vertically from the base 6. FIG. 1 shows an exercising person in the process of exercising with the exerciser.

Figure 2:
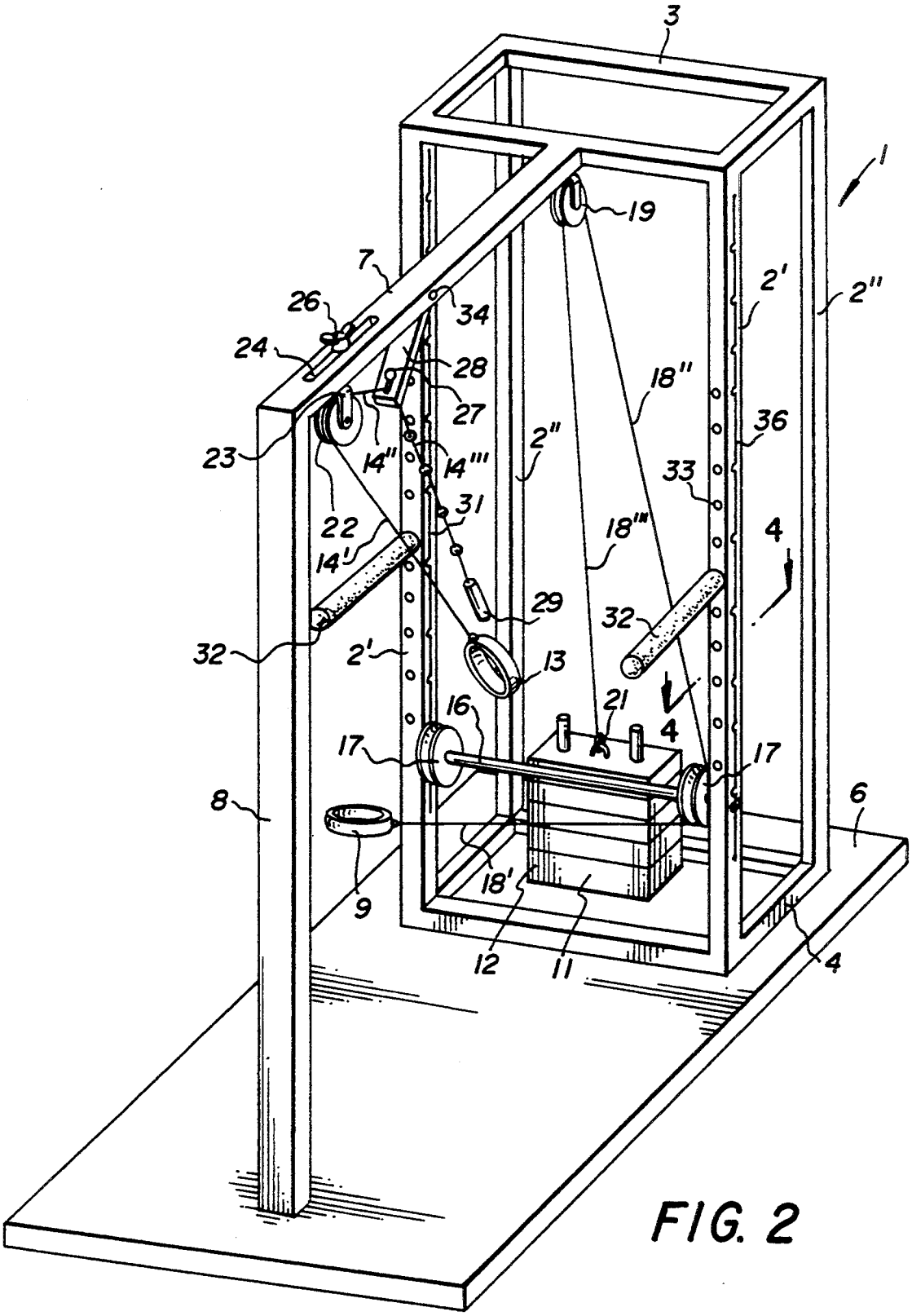
FIG. 2 is an elevational perspective view showing the exercising device according to FIG. 1 with the person removed from the drawing.

FIG. 2 shows the exerciser without the person to more clearly show the structural details of the exerciser.

In FIG. 1 the exercising person has an ankle strap 9 connected by a first pulley and rope arrangement, shown in more detail in FIG. 2, to an adjustable weight 11 that can be adjusted to any desired degree of heaviness by adding weight elements 12 to the weight 11. The exercising person has a knee strap 13 connected to a second rope and pulley arrangement that is arranged to support the exercising person's knee and leg in a raised position that enables him to practice kicking forward with his foot thereby exercising the muscle groups used in kicking by pulling the weight 11 upward as his foot moves forward. It follows that he can also turn around facing the frame 1 and practice kicking his foot backwards, thereby stimulating and developing those muscle groups used in backward kicking. He can also adjust the exerciser to develop arm muscles as described below.

In FIG. 2 the ankle strap 9 and the knee strap 13 are shown in the same positions as in FIG. 1.

The first pulley and rope system includes a cross member 16 supported at its ends in cut-outs in respective forward uprights 2', rotatably supporting one or two pulleys 17, and a first upper pulley 19, and a rope including a rope section 18' reaching from the ankle strap 9 to one of the pulleys 17, and from there via rope section 18'' to upper pulley 19, and from there down to the weight 11 via rode section 18''' and attached via a shackle 21 to the weight 11.

Figure 5:
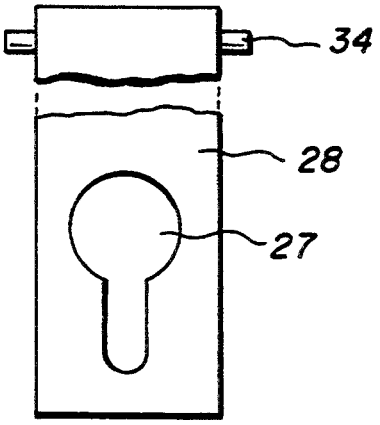
FIG. 5 is a detail of a rope retaining element with an inverted keyhole.

The knee strap 13 is connected via a second rope and pulley system including a second top pulley 22 connected to the underside of the forward projecting support element 7 and attached thereto by a swivel arrangement 23, slidably secured in a slot 24 with a wing nut 26, and a second rope including a second rope section 14' connecting the knee strap 13 with the second top pulley 22, and a further second rope section 14'' reaching from second top pulley 22 through an inverted keyhole 27 in a rope retainer 28 to a handle 29 via a still further second rope section 14''' which has a number of beads 31 spaced along the rope section 14''' and attached thereto, so that the height of the knee strap 13 can be adjusted by selecting a suitable bead 31 to be retained in the inverted keyhole 27. Two arm or hand rests 32 are attached projecting forwardly from the forward uprights 2' and may advantageously be adjustable in height by being inserted in any one of a number of holes 33 in the uprights 2'. The rope retainer 28 is pivotably attached to the forward projecting support element 7 by means of a bolt 34, seen in more detail in FIG. 5, which shows the rope retainer 28 with the inverted keyhole 27.

Figure 4:
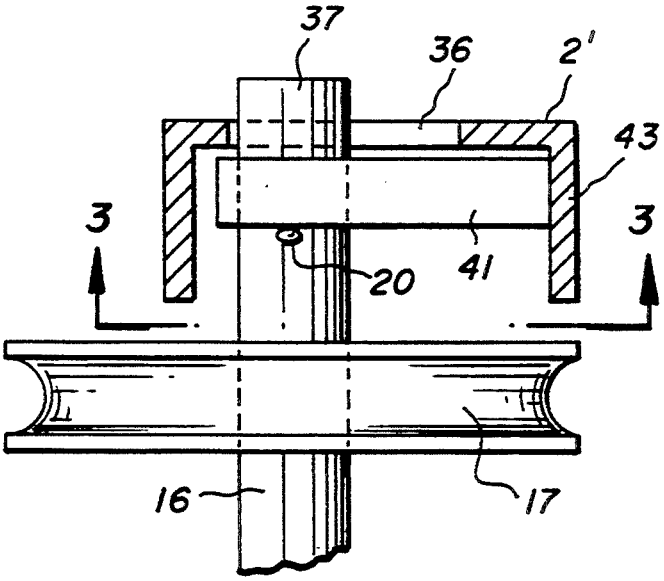
FIG. 4 is a fragmentary enlarged detail view showing a cross member with a pulley seen along the line 4—4 of FIG. 1, and also showing a retaining pawl.

The cross member 16 is vertically adjustable with its ends vertically movable up and down in respective channels 36 in the sides of the forward uprights 2' as shown in more detail in FIG. 4, which shows a cross-section through the upright 2' seen along the line 4—4 of FIG. 2.

Figure 3:
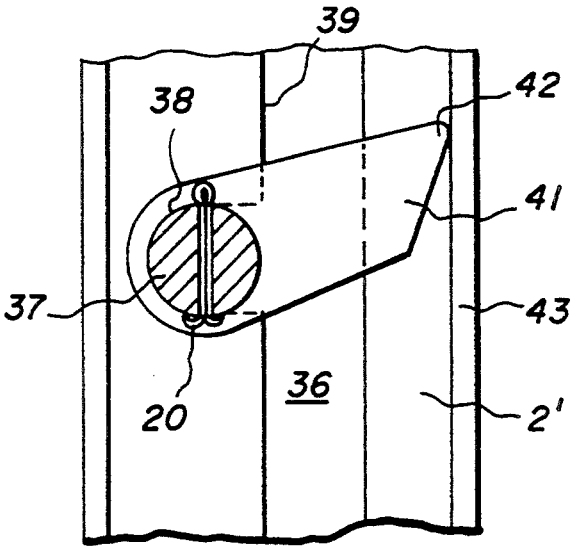
FIG. 3 is a fragmentary enlarged detail view showing an upright with a channel for holding the pulley cross member in a cutout, seen along the line 3—3 of FIG. 4.

As seen in FIG. 4, the end 37 of the cross member 16 projects through the channel 36, also seen in FIG. 3, wherein the end of the cross member 16 is positioned in cutoff 38 formed in the side edge 39 of the channel 36. A pawl 41 is loosely pivotable about the cross member 16, and has a tip 42 that rests against a rear flange 43 of the forward upright 2'. As seen in FIG. 4 the upright 2' has a cross-section as a U-channel profile. The pawl 41 is prevented from sliding inward on the cross member 16 by a cotter pin 20 or the like, through the cross member 16.

Figure 6:
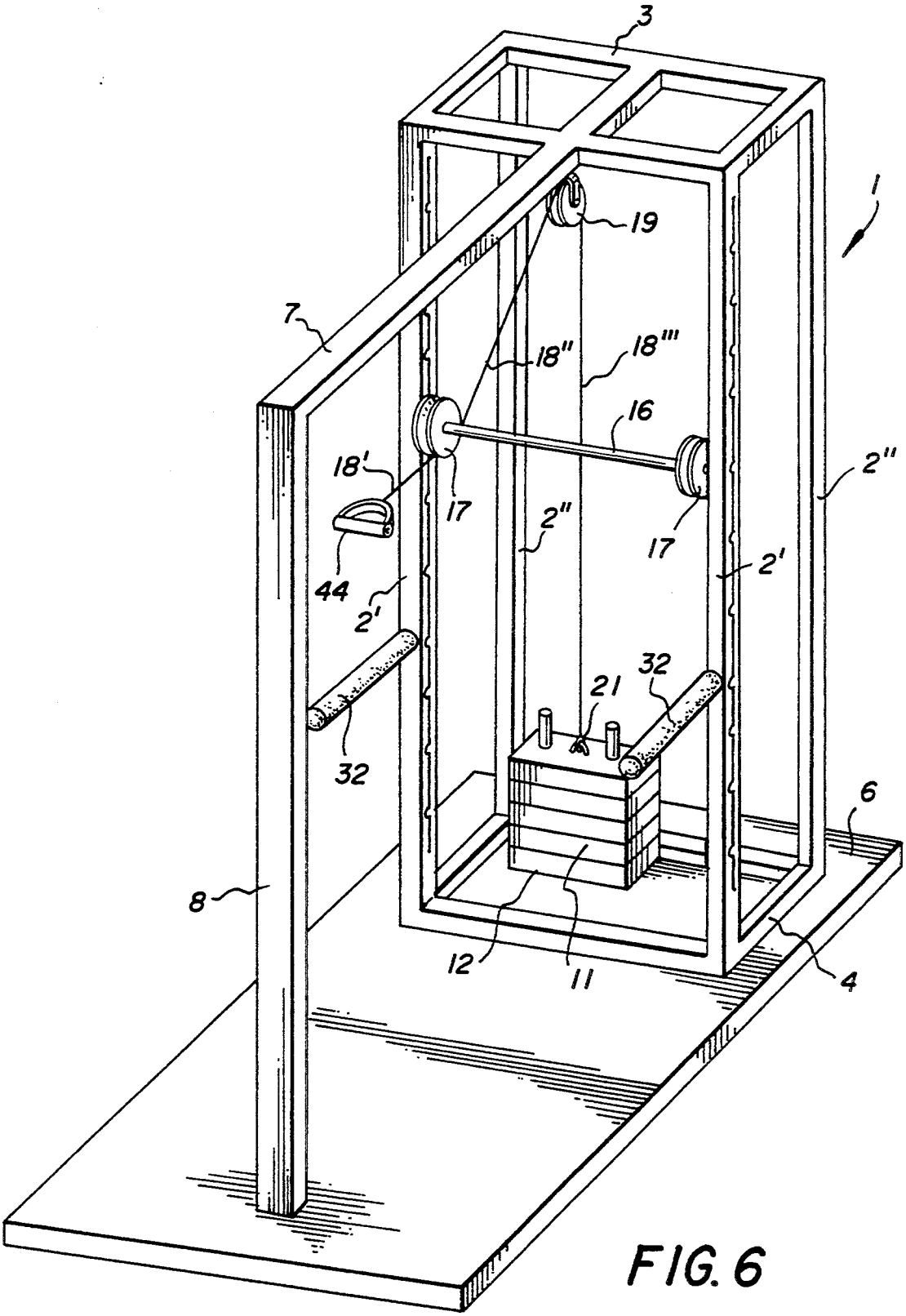
FIG. 6 is a perspective view of the invention with the pulley cross-member raised for exercising arm muscles.

FIG. 6 shows the exercising device arranged for exercising arm muscles. To that end the cross member 16 has been raised to a height comfortable to the exercising person. Instead of an ankle strap, a handle 44 has been attached to the rope section 18' of the first pulley and rope system, which is now arranged with the second rope section 18'' reaching from the pulley 17 to the first top pulley 19, and from there via the third rope section 18''' down to the weight 11. As the exerciser pushes the handle 44 in a forward hand thrust he raises the weight via the pulley and rope system as described above, which is adjusted to a degree of heaviness selected by the exercising person.

I claim:

1. A leg and arm exerciser for a person comprising:

resistance means for resisting a forward kicking motion of an exercised leg including:

an ankle strap;

a weight;

a frame for supporting the weight;

a rope connecting the weight and the ankle strap; and guiding means for guiding the rope so as to raise the weight with a forward kicking motion of an exercised leg of a standing person to which the ankle strap is attached, including a fixed pulley fixedly attached to the frame above the weight; and supporting means for supporting the knee of the exercised leg in a raised position including:

a knee strap;

a second rope connecting the knee strap and the frame; and a slidable pulley slidable attached to the frame for guiding the second rope intermediate the knee strap and frame.

2. A leg and an arm exerciser according to claim 1, wherein said weight includes a plurality of weight elements.

3. A leg and arm exerciser according to claim 1, including in said frame at least two forward uprights, a cross member disposed between said forward uprights, and at least one guiding means rotatably attached to said cross member.

4. A leg and arm exerciser according to claim 3, including securing means for vertically securing said cross member at a selected height on said uprights, said securing means including a vertical channel in each of said uprights, and a plurality of cutouts in said channel for supporting said cross member at its ends in respective cutouts.

5. A leg and arm exerciser according to claim 4, wherein said cross member is a round bar, and including a pawl with a hole for receiving a respective end of said round bar, said pawl having a pawl tip for securing said round bar in said cutout, said pawl tip adapted to rest against an inside wall of said upright.

6. A leg and arm exerciser according to claim 3 including a pair of hand rests, each hand rest attached to a respective one of said forward uprights projecting away from said frame.

7. A leg and arm exerciser according to claim 1, wherein said frame includes a forward projecting support element connected between a top part of said frame and floor level for preventing said frame from tipping forward during exercising.

8. A leg and arm exerciser according to claim 1, including a plurality of stops on said second rope for connection to said frame so as to support the knee of the exercised leg at a fixed height according to a selected one of said stops.

9. A leg and arm exerciser according to claim 8 wherein said plurality of stops include a plurality of beads on said second rope, and a keyhole slot for retaining a selected one of said beads.

10. A leg and arm exerciser according to claim 1 including a horizontal base for supporting said exerciser on a floor surface.

11. A leg and arm exerciser according to claim 1, wherein said frame is shaped as an upstanding parallelepiped having four uprights, said uprights having upper and lower ends, said upper and lower ends respectively connected by an upper and lower end frame shaped like a parallelogram.

* * * * *